US005081177A

United States Patent [19]

Shin

[11] Patent Number: 5,081,177

[45] Date of Patent: Jan. 14, 1992

[54] HALOCARBONS FOR FLASH-SPINNING POLYMERIC PLEXIFILAMENTS

[75] Inventor: Hyunkook Shin, Wilmington, Del.

[73] Assignee: E. I. Du Pont de Nemours and Company, Wilmington, Del.

[21] Appl. No.: 656,037

[22] Filed: Feb. 19, 1991

Related U.S. Application Data

[60] Division of Ser. No. 485,666, Feb. 27, 1990, Pat. No. 5,023,025, which is a continuation-in-part of Ser. No. 379,291, Jul. 18, 1989, abandoned, which is a continuation-in-part of Ser. No. 238,442, Aug. 30, 1988, abandoned.

[51] Int. Cl.[5] ..... C08K 5/02

[52] U.S. Cl. ..... 524/462; 524/463

[58] Field of Search ..... 524/462, 463

[56] References Cited

U.S. PATENT DOCUMENTS

| | | | |
|---|---|---|---|
| 3,081,519 | 3/1963 | Blades et al. | 28/81 |
| 3,169,899 | 2/1965 | Steuber | 161/72 |
| 3,227,794 | 1/1966 | Anderson et al. | 264/205 |
| 3,655,498 | 4/1972 | Woodell | 161/172 |
| 4,554,207 | 11/1985 | Lee | 428/288 |

FOREIGN PATENT DOCUMENTS

| | | |
|---|---|---|
| 62-33816 | 2/1987 | Japan . |
| 62-243642 | 10/1987 | Japan . |
| 62-250220 | 10/1987 | Japan . |
| 891943 | 3/1962 | United Kingdom . |
| 891945 | 3/1962 | United Kingdom . |

OTHER PUBLICATIONS

P. S. Zurer, "Search Intensifies for Alternatives to Ozone-Depleting Halocarbons", *Chem. & Eng. News*, pp. 17-20 (2/8/88).

Flourocarbon/Ozone Update, "Alternatives to Fully Halogenated Chlorofluorocarbons", The DuPont Development Program, DuPont Bulletin E-90566 (3/87).

*Primary Examiner*—Paul R. Michl

*Assistant Examiner*—Andrew Merriam

[57] ABSTRACT

An improved process is provided for flash-spinning plexifilamentary film-fibril strands of fiber-forming polyolefin from a small group halocarbon liquids that, if released to the atmosphere, present a greatly reduced ozone depletion hazard, as compared to the halocarbon currently-used commerically for making the strands. The preferred halocarbon for this purpose is 1,1-dichloro-2,2,2-trifluoroethane.

9 Claims, No Drawings

HALOCARBONS FOR FLASH-SPINNING POLYMERIC PLEXIFILAMENTS

CROSS-REFERENCE TO RELATED APPLICATION

This is a division of application Ser. No. 07/485,666, filed Feb. 27, 1990, now U.S. Pat. No. 5,023,025, which is a continuation-in-part of application Ser. No. 07/379,291 filed July 18, 1989, now abandoned, which in turn is a continuation-in-part of application Ser. No. 07/238,442 filed Aug. 30, 1988, now abandoned.

BACKGROUND OF THE INVENTION

1. Field of the Invention

This invention relates to flash-spinning polymeric film-fibril strands. More particularly, the invention concerns an improvement in such a process which permits flash-spinning of the strands from liquids which, if released to the atmosphere, would not detrimentally affect the earth's ozone.

2. Description of the Prior Art

Blades and White, U.S. Pat. No. 3,081,519, describes a flash-spinning process for producing plexifilamentary film-fibril strands from fiber-forming polymers. A solution of the polymer in a liquid, which is a non-solvent for the polymer at or below its normal boiling point, is extruded at a temperature above the normal boiling point of the liquid and at autogenous or higher pressure into a medium of lower temperature and substantially lower pressure. This flash-spinning causes the liquid to vaporize and thereby cool the exudate which forms a plexifilamentary film-fibril strand of the polymer. Preferred polymers include crystalline polyhydrocarbons such as polyethylene and polypropylene.

According to Blades and White, a suitable liquid for the flash spinning desirably (a) has a boiling point that is at least 25° C. below the melting point of the polymer; (b) is substantially unreactive with the polymer at the extrusion temperature; (c) should be a solvent for the polymer under the pressure and temperature set forth in the patent (i.e., these extrusion temperatures and pressures are respectively in the ranges of 165° to 225° C. and 545 to 1490 psia); (d) should dissolve less than 1% of the polymer at or below its normal boiling point; and should form a solution that will undergo rapid phase separation upon extrusion to form a polymer phase that contains insufficient solvent to plasticize the polymer. Depending on the particular polymer employed, the following liquids are useful in the flash-spinning process: aromatic hydrocarbons such as benzene, toluene, etc.; aliphatic hydrocarbons such as butane, pentane, hexane, heptane, octane, and their isomers and homologs; alicyclic hydrocarbons such as cyclohexane; unsaturated hydrocarbons; halogenated hydrocarbons such as methylene chloride, carbon tetrachloride, chloroform, ethyl chloride, methyl chloride; alcohols; esters; ethers; ketones; nitriles; amides; fluorocarbons; sulfur dioxide; carbon disulfide; nitromethane; water; and mixtures of the above liquids. The patent also diagrammatically illustrates certain principles helpful in establishing optimum spinning conditions to obtain plexifilamentary strands. Blades and White states that the flash-spinning solution additionally may contain a dissolved gas, such as nitrogen, carbon dioxide, helium, hydrogen, methane, propane, butane, ethylene, propylene, butene, etc. Preferred for improving plexifilament fibrillation are the less soluble gases, i.e., those that are dissolved to a less than 7% concentration in the polymer solution under the spinning conditions. Common additives, such as antioxidants, UV stabilizers, dyes, pigments and the like also can be added to the solution prior to extrusion.

Anderson and Romano, U.S. Pat. No. 3,227,794, discloses a diagram similar to that of Blades and White for selecting conditions for spinning plexifilamentary strands. A graph is presented of spinning temperature versus spinning pressure for solutions of 10 to 16 weight percent of linear polyethylene in trichlorofluoromethane. This patent also describes in detail the preparation of a solution of 14 weight percent high density linear polyethylene in trichlorofluoromethane at a temperature of about 185° C. and a pressure of about 1640 psig which is then flash-spun from a let-down chamber at a temperature of 185° C. and a pressure of 1050 psig. Very similar temperatures, pressures and concentrations have been employed in commercial flash-spinning of polyethylene into plexifilamentary film-fibril strands, which were then converted into sheet structures.

Although trichlorofluoromethane has been a very useful solvent for flash-spinning plexifilamentary film-fibril strands of polyethylene, and has been the solvent used in commercial manufacture of polyethylene plexifilamentary strands, the escape of such a halocarbon into the atmosphere has been implicated as a source of depletion of the earth's ozone. A general discussion of the ozone-depletion problem is presented, for example, by P. S. Zurer, "Search Intensifies for Alternatives to Ozone-Depleting Halocarbons", *Chemical & Engineering News*, pages 17–20 (Feb. 8, 1988).

A convenient test to determine whether a given solvent would be suitable for flash-spinning a given polymer is disclosed by Woodell, U.S. Pat. No. 3,655,498. This test has been used extensively by the world's largest manufacturer of flash-spun polyethylene products to determine the suitability of alternatives to the trichlorofluoromethane solvent for preparing plexifilamentary strands. In the test, a mixture of the polymer plus the amount of solvent calculated to give about a 10 weight percent solution, is sealed in a thick-walled glass tube (the mixture occupies about one-third to one-half the tube volume) and the mixture is heated at autogenous pressure. Test temperatures usually range from about 100° C. to just below the critical temperature of the liquid being tested. Woodell states that if a single-phase, flowable solution is not formed in the tube at any temperature below the solvent critical temperature, $T_c$, (or the polymer degradation temperature, whichever is lower) the solvent power is too low. At the other extreme, if a single phase solution is formed at some temperature below $T_c$, but that solution cannot be converted to two liquid phases on being heated to a higher temperature (still below $T_c$), the solvent power is too high. Solvents whose inherent solvent power fails to fall within these extremes may be made suitable by dilution with either a non-solvent or a good-solvent additive, as appropriate. After choosing a suitable solvent or solvent mixture, the single-phase and two-liquid-phase boundary behavior of the solvent or mixture can be determined as a function of temperature and pressure at different polymer concentrations, as described by Anderson and Romano, mentioned above.

An object of this invention is to provide an improved process for flash-spinning plexifilamentary film-fibril strands of fiber-forming polyolefin, wherein the solvent should not be a depletion hazard to the earth's ozone.

SUMMARY OF THE INVENTION

In one embodiment, the present invention provides an improved process for flash-spinning plexifilamentary film-fibril strands wherein polyethylene is dissolved in a halocarbon spin liquid to form a spin solution containing 10 to 20 percent of polyethylene by weight of the solution at a temperature in the range of 130° to 210° C. and a pressure that is greater than 2400 psi, preferably greater than 3000 psi, which solution is flash-spun into a region of substantially lower temperature and pressure, the improvement comprising the halocarbon being selected from the group consisting of.

1,1-dichloro-2,2,2-trifluoroethane,
1,2-dichloro-1,2,2-trifluoroethane and
1,1-dichloro-1,2,2-trifluoroethane.

In a preferred mode of the foregoing embodiment, the polyethylene has a melt index of at least 4 and a density of about 0.92–0.98 and it is dissolved in at least one isomer of dichlorotrifluoroethane, preferably 1,1-dichloro-2,2,2-trifluoroethane, to form a spin solution containing 10 to 20 percent of the polyethylene by weight of the solution at a temperature in the range of 130° to 210° C. and a pressure that is greater than 2400 psi followed by flash-spinning the solution into a region of substantially lower temperature and pressure.

In another embodiment the present invention provides an improved process for flash-spinning plexifilamentary film-fibril strands wherein polyethylene is dissolved in a halocarbon spin liquid to form a spin solution containing 10 to 20 percent of polyethylene by weight of the solution at a temperature in the range of 130° to 210° C. and a pressure that is greater than 1,800 psi which solution is flash-spun into a region of substantially lower temperature and pressure, the improvement comprising the halocarbon being selected from the group consisting of 1,1-dichloro-2,2-difluoroethane,
1,2-dichloro-1,1-difluoroethane,
1,1-dichloro-1,2-difluoroethane and
1,2-dichloro-1,2-difluoroethane.

In another embodiment, the present invention provides an improved process for flash-spinning plexifilamentary film-fibril strands wherein polyethylene is dissolved in a halocarbon spin liquid to form a spin solution containing 10 to 20 percent of polyethylene by weight of the solution at a temperature in the range of 130° to 210° C. and a pressure that is greater than 1,000 psi which solution is flash-spun into a region of substantially lower temperature and pressure, the improvement comprising the halocarbon being 1,1-dichloro-1-fluoroethane.

In another embodiment the present invention provides an improved process for flash-spinning plexifilamentary film-fibril strands wherein polypropylene is dissolved in a halocarbon spin liquid to form a spin solution containing 8 to 20 percent of polypropylene by weight of the solution at a temperature in the range of 130° to 230° C., preferably 170° to 210° C., and a pressure that is greater than 1,000 psi which solution is flash-spun into a region of substantially lower temperature and pressure, the improvement comprising the halocarbon being selected from the group consisting of 1,1-dichloro-2,2,2-trifluoroethane,
1,2-dichloro-1,2,2-trifluoroethane,
1,1-dichloro-1,2,2-trifluoroethane
1,1-dichloro-2,2-difluoroethane,
1,2-dichloro-1,1-difluoroethane,
1,1-dichloro-1,2-difluoroethane,
1,2-dichloro-1,2-difluoroethane,
1,1-dichloro-1-fluoroethane,
1,2-dichloro-2-fluoroethane and
1,1-dichloro-2-fluoroethane.

In still another embodiment, the present invention provides an improved process for flash-spinning plexifilamentary film-fibril strands wherein a fiber-forming polyethylene is dissolved in a halocarbon spin liquid at a temperature in the range of 130° to 210° C. and a pressure that is greater than 1000 psia wherein the spin liquid further contains a co-solvent, either a hydrocarbon which amounts to 2 to 25 percent of the total weight of spin liquid or methylene chloride which amounts to 5 to 50 percent of the total weight of spin liquid, to form a spin solution containing 10 to 20 percent of fiber-forming polyethylene by weight of the solution and then is flash-spun into a region of substantially lower temperature and pressure, the improvement comprising the halocarbon being selected from the group consisting of 1,1-dichloro-2,2,2-trifluoroethane,
1,2-dichloro-1,2,2-trifluoroethane,
1,1-dichloro-1,2,2-trifluoroethane,
1,1-dichloro-2,2-difluoroethane,
1,2-dichloro-1,1-difluoroethane,
1,1-dichloro-1,2-difluoroethane,
1,2-dichloro-1,2-difluoroethane,
1,1-dichloro-1-fluoroethane,
1,2-dichloro-2-fluoroethane and
1,1-dichloro-2-fluoroethane.

The present invention provides a novel solution consisting essentially of 8 to 20 weight percent of a fiber-forming polyolefin and 92 to 80 weight percent of a liquid containing a halocarbon selected from the group consisting of 1,1-dichloro-2,2,2-trifluoroethane,
1,1-dichloro-1,2,2-trifluoroethane,
1,2-dichloro-1,2,2-trifluoroethane,
1,1-dichloro-1,2-difluoroethane,
1,2-dichloro-1,2-difluoroethane,
1,1-dichloro-2,2-difluoroethane,
1,2-dichloro-1,1-difluoroethane,
1,1-dichloro-1-fluoroethane
1,2-dichloro-2-fluoroethane and
1,1-dichloro-2-fluoroethane.

The present invention provides a novel solution consisting essentially of 8 to 20 weight percent of a fiber-forming polyolefin and 92 to 80 weight percent of a halocarbon liquid selected from the group consisting of 1,1-dichloro-2,2,2-trifluoroethane,
1,2-dichloro-1,2,2-trifluoroethane,
1,1-dichloro-1,2,2-trifluoroethane,
1,1-dichloro-1,2,2-trifluoroethane, 1,1-dichloro-2,2-difluoroethane,
1,2-dichloro-1,1-difluoroethane,
1,1-dichloro-1,2-difluoroethane,
1,2-dichloro-1,2-difluoroethane
1,1-dichloro-1-fluoroethane
1,2-dichloro-2-fluoroethane and
1,1-dichloro-2-fluoroethane.

DETAILED DESCRIPTION OF PREFERRED EMBODIMENTS

The term "polyolefin" as used herein, is intended to mean any of a series of largely saturated open chain polymeric hydrocarbons composed only of carbon and hydrogen. Typical polyolefins include, but are not limited to, polyethylene, polypropylene, and polymethylpentene. Conveniently, polyethylene and polypropylene are the preferred polyolefins for use in the process of the present invention.

"Polyethylene" as used herein is intended to embrace not only homopolymers of ethylene, but also copolymers wherein at least 85% of the recurring units are ethylene units. One preferred polyethylene is a linear high density polyethylene which has an upper limit of melting range of about 130° to 135° C., a density in the range of 0.94 to 0.98 g/cm$^3$ and a melt index (as defined by ASTM D-1238-57T, Condition E) of greater than 0.1, and preferably below 100. Another preferred polyethylene is a linear low density polyethylene having a density of about 0.92–0.94 and a melt index of at least 4, preferably also below 100.

The term "polypropylene" is intended to embrace not only homopolymers of propylene but also copolymers wherein at least 85% of the recurring units are propylene units.

The term "plexifilamentary film-fibril strands" as used herein, means a strand which is characterized as a three-dimensional integral network of a multitude of thin, ribbon-like, film-fibril elements of random length and of less than about 4 microns average thickness, generally coextensively aligned with the longitudinal axis of the strand. The film-fibril elements intermittently unite and separate at irregular intervals in various places throughout the length, width and thickness of the strand to form the three-dimensional network. Such strands are described in further detail by Blades and White, U.S. Pat. No. 3,081,519 and by Anderson and Romano, U.S. Pat. No. 3,227,794.

The present invention provides an improvement in the known process for producing plexifilamentary film-fibril strands of fiber-forming polyolefins from a halocarbon spin liquid that contains 8 to 20 weight percent of the fiber-forming polyolefin. In the known processes, which were described in the above-mentioned United States patents, a fiber-forming polyolefin, e.g. linear polyethylene, is dissolved in a spin liquid that includes a halocarbon to form a spin solution containing 10 to 20 percent of the linear polyethylene by weight of the solution and then is flash-spun at a temperature in the range of 130° to 230° C. and a pressure that is greater than the autogenous pressure of the spin liquid into a region of substantially lower temperature and pressure.

The key improvement of the present invention requires the halocarbon to be selected from the group consisting of 1,1-dichloro-2,2,2-trifluoroethane ("HC-123"),
1,2-dichloro-1,2,2-trifluoroethane ("HC-123a"),
1,1-dichloro-1,2,2-trifluoroethane ("HC-123b"),
1,1-dichloro-2,2-difluoroethane ("HC-132a"),
1,2-dichloro-1,1-difluoroethane ("HC-132b"),
1,1-dichloro-1,2-difluoroethane ("HC-132c"),
1,2-dichloro-1,2-difluoroethane ("HC-132")
1,1-dichloro-1-fluoroethane ("HC-141b")
1,2-dichloro-2-fluoroethane ("HC-141") and
1,1-dichloro-2-fluoroethane ("HC-141a").

The parenthetic designation is used herein as an abbreviation for the chemical formula of the halocarbon. The following table lists the known normal atmospheric boiling points (Tbp), critical temperatures (Tcr) and critical pressures (Pcr) for the selected halocarbons and for some prior art solvents. In the column labeled "Solubility", the Table also lists whether a 10% polyethylene solution can be formed as a single phase in the halocarbon or hydrocarbon at temperatures between 100° and about 225° C. under autogenous pressures.

| | Tbp, °C. | Tcr, °C. | Pcr, psia | Solubility |
|---|---|---|---|---|
| HC-123 | 28.7 | 185 | 550 | no |
| HC-123a | 28 | | | no |
| HC-123b | 30.2 | | | |
| HC-132a | 60 | 238 | | no |
| HC-132b | 46.8 | 220 | 570 | no |
| HC-132c | 48.4 | | | no |
| HC-132 | 59 | | | |
| HC-141b | 32 | 210 | 673 | no |
| HC-141 | 75.7 | | | |
| HC-141a | | | | |
| Trichloro-fluoromethane | 23.8 | 198.0 | 639.5 | yes |
| Methylene-chloride | 39.9 | 237.0 | 894.7 | yes |
| Hexane | 68.9 | 234.4 | 436.5 | yes |
| Cyclohexane | 80.7 | 280.4 | 590.2 | yes |

Note that the suitable halocarbons listed above represent a very particular and small group of halocarbons that are suitable for use in the present invention. There are hundreds of halocarbons to select from. The conventional method of screening liquids (i.e., by means of the autogenous pressure polyethylene solubility test, described above) is inadequate as the halocarbons discovered to be useful for the present invention do not dissolve the polyethylene at autogenous pressures, in constrast to the prior art solvents shown above that would have been selected for further study because they do form solutions with the polyethylene at autogenous pressure. In contrast to the flash spinning fluids of the past, none of the halocarbons of the present invention form a single phase solution with polyethylene at the required concentrations and temperatures at the autogeneous pressure of the solvent.

It has been found that in the case when a dichlorotrifluoroethane such as 1,1-dichloro-2,2,2-trifluoroethane ("HC-123") is the solvent it is entirely practical to produce a solution of 10 to 20 weight percent of polyethylene having a melt index of at least 4 and a density of about 0.92–0.98 and then to flash-spin the solution at temperatures of 130° to 210° C. and comparatively low pressure to produce high quality products. For this combination it is not necessary that the solution be formed into a single phase, it is sufficient that a homogeneous two phase solution be formed and spun as such. Indeed at pressures below about 5000–8000 psi such solutions will usually be of two-phases but high quality products can nonetheless be produced. This behavior is typical for most polyethylenes in HC-123 solvent and its isomers.

These halocarbons do, of course, have certain characteristics that are also possessed by the known fiber-forming polyolefin flash-spinning liquids. For example, these halocarbons also are substantially unreactive with the polymer at the extrusion temperature. These halocarbons are solvents for the fiber-forming polyolefin under certain conditions, dissolve less than 1% of the polymer at or below their normal boiling points and form solutions that undergo rapid phase separation upon extrusion to form a polymer phase that contains insufficient solvent to plasticize the polymer.

In addition to the above-stated characteristics, halocarbons suitable for use in the process and solutions of the present invention (1) have boiling points in the range of 0° to 80° C., (2) are incompletely fluorinated and/or chlorinated, (3) have low flammability, (4) have adequate heat of vaporization to permit rapid cooling of the plexifilament when it is formed upon flash spinning, (5) have adequate thermal and hydrolytic stability for use in the flash spinning process, (6) have a sufficiently high electrostatic breakdown potential in the gaseous state so that they can be used in conventional spunbonded processes for forming sheets of the plexifilament (e.g., Steuber, U.S. Pat. No. 3,169,899) without exhibiting excessive decomposition of the halocarbon and (7) cannot form a single phase 10 weight percent solution of polyethylene in the liquid at temperatures in the range of 130° to 200° C. at the autogeneous pressure of the solvent. Specifically, with HC-123 and HC-123a, such solutions of polyethylene can be formed in the halocarbon liquid only at pressures greater than 2,400 psi; with HC-132a and HC-132b, such solutions of polyethylene can be formed in the halocarbon liquid only at pressures greater than 1,800 psi and with HC-141b, such solutions of polyethylene can be formed in the halocarbon liquid only at pressures greater than the autogeneous pressure of the solvent. Such solutions of polypropylene can be formed in the halocarbon spin liquids of this invention at pressures greater than the autogeneous pressure of the solvent.

Satisfactory solutions of polyethylene and halocarbon can be formed at pressures as low as 1,000 psi when co-solvents of high solvent power are present in the halocarbon spin liquid.

The combination of halocarbon characteristics have been discovered to be met substantially by only the ten halocarbons, listed above. To be an equivalent of any of the halocarbons of the invention, a newly developed or discovered halocarbon would also have to meet substantially all of these characteristics in order to be suitable for flash-spinning high quality, plexifilamentary film-fibril strands of fiber-forming polyolefin.

Even among the halocarbons suitable for use in the process of the invention, care must be taken with these halocarbons to avoid certain disadvantageous characteristics which may be present. For example, excessive heating times are avoided with HC-123a, HC-132a, HC-132b and HC-141b to minimize decomposition that can arise from dehydrohalogenation or hydrolysis of the halocarbon. Care must also be taken with HC-132b, because there have been some indications that this chemical may be a male-animal-reproductive toxin. Because of its relative freedom from all of these stability and toxicity problems, HC-123 is the preferred halocarbon for use in the process of the invention.

In forming a solution of fiber-forming polyolefin in the halocarbon liquids of the invention, a mixture of the fiber-forming polyolefin and halocarbon is raised to a temperature in the range of 130° to 230° C. If polyethylene is the polyolefin; the mixture is under a pressure of greater than 1,000 psi if the halocarbon is HC-141b, greater than 2,400 psi if the halocarbon is HC-123 or HC-123a and greater than 1,800 psi if the halocarbon is HC-132a or HC-132b. If polypropylene is used, the pressure is greater than 1,000 psi regardless of the halocarbon chosen. The mixtures described above are held under the required pressure until a solution of the fiber-forming polyolefin is formed in the liquid. Usually, maximum pressures of less than 10,000 psi are satisfactory. After the fiber-forming polyolefin has dissolved, the pressure may be reduced somewhat and the mixture is then flash spun to form the desired high quality plexifilamentary strand structure.

The concentration of fiber-forming polyolefin in the spin liquid usually is in the range of 8–20 percent, preferably 10–20 percent, based on the total weight of the liquid and the fiber-forming polyolefin.

The spin solution preferably consists of halocarbon liquid and fiber-forming polyolefin, but if lower pressures are desired for solution preparation and spinning, the spin solution can contain a second liquid, or co-solvent, for the fiber-forming polyolefin. When the co-solvent is a hydrocarbon solvent, such as cyclohexane, toluene, chlorobenzene, hexane, pentane, 3-methyl pentane and the like, the concentration of the co-solvent in the mixture of halocarbon and co-solvent generally amounts to 2 to 25 weight percent and preferably less than 15 weight percent to minimize potential flammability problems. However, when methylene chloride is employed as the co-solvent, concentrations of the methylene chloride in the halocarbon/co-solvent mixture (i.e., free of fiber-forming polyolefin) generally amount to 5 to 50 weight percent.

Conventional flash-spinning additives can be incorporated into the spin mixtures by known techniques. These additives can function as ultraviolet-light stabilizers, antioxidants, fillers, dyes, and the like.

The various characteristics and properties mentioned in the preceding discussion and in the examples below were determined by the following procedures.

TEST METHODS

Solubility of the polyethylene and polypropylene under autogenous conditions were measured by the convenient sealed-tube test of Woodell, U.S. Pat. No. 3,655,498, that was also described in the next to last paragraph of the "Description of the Prior Art" section of this document.

The quality of the plexifilamentary film-fibril strands produced in the examples was rated subjectively. A rating of "5" indicates that the strand had better fibrillation than is usually achieved in the commercial production of spunbonded sheet made from such flash-spun polyethylene strands. A rating of "4" indicates that the product was as good as commercially flash-spun strands. A rating of "3" indicates that the strands were not quite as good as the commercially flash-spun strands. A "2" indicates a very poorly fibrillated, inadequate strand. A "1" indicates no strand formation. A rating of "3" is the minimum considered satisfactory for use in the process of the present invention. The commercial strand product is produced from solutions of about 12.5% linear polyethylene in trichlorofluoromethane substantially as set forth in Lee, U.S. Pat. No. 4,554,207, column 4, line 63, through column 5, line 10, which disclosure is hereby incorporated by reference.

The surface area of the plexifilamentary film-fibril strand product is another measure of the degree and fineness of fibrillation of the flash-spun product. Surface area is measured by the BET nitrogen absorption method of S. Brunauer, P. H. Emmett and E. Teller, J. Am. Chem Soc., V. 60 p 309–319 (1938) and is reported as $m^2/g$.

Tenacity of the flash-spun strand is determined with an Instron tensile-testing machine. The strands are conditioned and tested at 70° F. and 65% relative humidity.

The denier of the strand is determined from the weight of a 15 cm sample length of strand. The sample is then twisted to 10 turns per inch and mounted in the jaws of the Instron Tester. A 1-inch gauge length and an elongation rate of 60% per minute are used. The tenacity at break is recorded in grams per denier (gpd).

The invention is illustrated in the Examples which follow with a batch process in equipment of relatively small size. Such batch processes can be scaled-up and converted to continuous flash-spinning processes that can be performed, for example, in the type of equipment disclosed by Anderson and Romano, U.S. Pat. No. 3,227,794. In the Examples and Tables, processes of the invention are identified with Arabic numerals. Processes identified with uppercase letters are comparison processes that are outside the invention. Parts and percentages are by weight unless otherwise indicated.

EXAMPLES

For each of Examples 1–25 and Comparisons A and B, a high density linear polyethylene of 0.76 Melt Index and density of 0.96 $g/cm^3$ was flash-spun into satisfactory plexifilamentary film-fibril strand in accordance with the invention (except for Example 7, in which a low density linear polyethylene of 26 Melt Index and density of 0.94 $g/cm^3$ was used).

For Example 26 polypropylene is used and for Examples 27 to 37 various types of polyethylenes are used. In these Examples LLDPE means linear low density polyethylene and HDPE means high density polyethylene.

Two types of apparatus were used to prepare the mixture of halocarbon and fiber-forming polyolefin and perform the flash-spinning. The apparatus designated "I" was employed for Examples 1, 5 and 17. The apparatus designated "II" was utilized for all other Examples and for the Comparisons.

Apparatus "I" is a high pressure apparatus comprising a cylindrical vessel of 50 $cm^3$ volume, fitted at one end with a cylindrical piston which is adapted to apply pressure to the contents of the vessel. The other end of the vessel is fitted with a spinneret assembly having an orifice of 0.030-inch diameter and 0.060-inch length and a quick-acting means for opening and closing the orifice. Means are included for measuring the pressure and temperature inside the vessel. In operation, the vessel is charged with fiber-forming polyolefin and halocarbon. A high pressure (e.g., 4,500 psi) is applied to the charge. The contents are heated at the desired temperature (e.g., 140° C.) for about an hour to effect the formation of a solution which is then "mixed" by cycling the pressure about ten times. The pressure is then reduced to that desired for spinning and the spinneret orifice valve opened. The resultant flash-spun product is then collected.

Apparatus "II" comprises a pair of high pressure cylindrical vessels, each fitted with a piston for applying pressure. The vessels are each similar to the cylindrical vessel of apparatus "I", but rather than having an orifice assembly in each vessel, the two are connected to each other with a transfer line. The transfer line contains a series of fine mesh screens intended for mixing the contents of the apparatus by forcing the contents through the transfer line from one cylinder to the other. A spinneret assembly having an orifice of 0.030-inch diameter is connected to the transfer lines with quick acting means for opening and closing the orifice. Means are included for measuring the pressure and temperature inside the vessel. For experiments 26 and 27 the spinneret assembly consists of a pressure letdown orifice of 0.03375 inch ($8.5\times10^{-4}$ m) diameter and a 0.030 inch length ($7.62\times10^{-4}$ m), a letdown chamber of 0.25 inch ($6.3\times10^{-3}$ m) diameter and 1.92 inch length, and a spinneret orifice of 0.30 inch ($7.62\times10^{-4}$ m) diameter. In operation, the apparatus is charged with fiber-forming polyolefin and halocarbon and a high pressure is applied to the charge. The contents then are heated at the desired temperature for about an hour and a half during which time a differential pressure of about 50 psi is alternately established between the two cylinders to repeatedly force the contents through the transfer line from one cylinder to the other to provide mixing and effect formation of a solution. The pressure desired for spinning is then set and the spinneret orifice opened. The resultant flash-spun product is then collected.

All Examples and Comparisons were performed in a similar fashion, depending on the apparatus used, under the specific conditions and with the particular ingredients shown in the following summary tables. The tables also record characteristics of the strands produced by the flash-spinning.

In Table I, Examples 1–7 illustrate the use of different halocarbons suitable for the process and solutions of the invention. Comparisons A and B show the use of some of the same halocarbons but under conditions that do not permit production of satisfactory strand.

TABLE I

| | Example No. | | | | | | | | | |
|---|---|---|---|---|---|---|---|---|---|---|
| | 1 | 2 | A | 3 | B | 4 | 5 | 6a | 6b | 7 |
| Apparatus | I | II | II | II | II | II | I | II | II | II |
| Polyethylene Conc, wt % | 14.4 | 12 | 12 | 12 | 12 | 12 | 11.4 | 12 | 12 | 12 |
| Solvent: HC | 123 | 123 | 123 | 132b | 132b | 141b | 123a | 132a | 132c | 132b |
| Mixing | | | | | | | | | | |
| Temp, °C. | 140 | 140 | 170 | 140 | 140 | 140 | 140 | 140 | 140 | 140 |
| Press, psig | 4500–3800 | 5700 | 2900 | 2000 | 1500 | 2500 | 4200 | 2500 | 2500 | 2500 |
| Spinning | | | | | | | | | | |
| Temp, °C. | 170 | 140 | 170 | 180 | 200 | 170 | 170 | 200 | 180 | 180 |
| Press, psig | 2500 | 3200–4200 | 2900 | 2000 | 1500 | 2500 | 2500 | 2500 | 2500 | 2500 |
| Strand Product | | | | | | | | | | |

TABLE I-continued

| | Example No. | | | | | | | | | |
|---|---|---|---|---|---|---|---|---|---|---|
| | 1 | 2 | A | 3 | B | 4 | 5 | 6a | 6b | 7 |
| Denier | 776 | 1003 | ns* | 476 | ns | 598 | nm** | nm | 535 | nm |
| Tenacity, gpd | 3.25 | 2.91 | ns | 3.03 | ns | 2.8 | nm | nm | 1.85 | nm |
| Quality | 4 | 4 | 1 | 4.5 | 1 | 4 | 3 | 4 | 4 | 3 |

In Table II, Examples 8–25 illustrate the use of various co-solvents with the halocarbons.

TABLE II

| | Example No. | | | | | | | | | |
|---|---|---|---|---|---|---|---|---|---|---|
| | 8 | 9 | 10 | 11 | 12 | 13 | 14 | 15 | 16 | 17 |
| Apparatus | II | II | II | II | II | II | II | II | I | II |
| Polyethylene Conc, wt % | 12 | 12 | 12 | 12 | 12 | 12 | 12 | 12 | 11.4 | 12 |
| Solvent: HC | 123 | 123 | 123 | 132b | 123 | 123 | 123 | 123 | 123 | 123 |
| Co-solvent | $CH_2Cl_2$ | $CH_2Cl_2$ | $CH_2Cl_2$ | 3-methyl pentane | $C_6H_{12}$ | $C_6H_{12}$ | toluene | toluene | pentane | hexane |
| wt %*** | 25 | 33 | 50 | 7 | 13.3 | 16.7 | 6.7 | 13.3 | 13.1 | 20 |
| Mixing | | | | | | | | | | |
| Temp, °C. | 140 | 140 | 140 | 140 | 140 | 140 | 140 | 140 | 140 | 140 |
| Press, psig | 2500 | 1800 | 2500 | 2500 | 2800 | 2500 | 2600 | 2000 | 4200–3700 | 2700 |
| Spinning | | | | | | | | | | |
| Temp, °C. | 170 | 160 | 170 | 200 | 170 | 170 | 170 | 160 | 170 | 170 |
| Press, psig | 2500 | 1800 | 2500 | 2500 | 2900 | 2500 | 2900 | 2000 | 3000 | 2900 |
| Strand Product | | | | | | | | | | |
| Denier | 577 | 566 | 686 | nm | 564 | 612 | 642 | 877 | | |
| Tenacity, gpd | 2.74 | 2.58 | 2.43 | nm | 2.3 | 1.96 | 2.41 | 1.70 | | |
| Surface Area, $m^2/g$ | 37.8 | 49.6 | 63.1 | nm | 34.9 | 28.0 | 15.9 | 25.6 | | |
| Quality | 4.5 | 4.5 | 4 | 4.5 | 5 | 5 | 4.5 | 4.5 | 4 | 5 |

| | Example No. | | | | | | | |
|---|---|---|---|---|---|---|---|---|
| | 18 | 19 | 20 | 21 | 22 | 23 | 24 | 25 |
| Apparatus | II | II | II | II | II | II | II | II |
| Polyethylene Conc, wt % | 12 | 12 | 12 | 15 | 12 | 12 | 12 | 12 |
| Solvent: HC | 123 | 123 | 123 | 123 | 123 | 123 | 123 | 123 |
| Co-solvent | chlorobenzene | $CH_2Cl_2$ | $CH_2Cl_2$ | $CH_2Cl_2$ | $CH_2Cl_2$ | $CH_2Cl_2$ | $C_6H_{12}$ | toluene |
| wt %*** | 6.7 | 5 | 10 | 10 | 32.5 | 40 | 5 | 5 |
| Mixing | | | | | | | | |
| Temp, °C. | 140 | 140 | 140 | 140 | 140 | 140 | 140 | 140 |
| Press, psig | 2600 | 5500 | 5500 | 4000 | 1800 | 1800 | ~5500 | 4000 |
| Spinning | | | | | | | | |
| Temp, °C. | 170 | 170 | 160 | 170 | 170 | 200 | 170 | 170 |
| Press, psig | 2800 | ~4700 | ~4700 | ~3500 | 1575 | 1575 | ~5000 | ~3650 |
| Strand Product | | | | | | | | |
| Denier | | 527 | 374 | 596 | 486.8 | 399.2 | 707 | 549 |
| Tenacity, gpd | | 4.61 | 2.93 | 4.22 | 2.67 | 2.43 | 1.79 | 2.94 |
| Surface Area, $m^2/g$ | | 34.2 | 36.4 | 52.9 | 29.7 | 36.2 | 34.9 | 30.5 |
| Quality | 4 | 4 | 5 | 4 | 5 | 4.5 | 4 | 4 |

*"ns" means no strand formed
**"nm" means no measurement was made
+ $C_6H_{12}$ is cyclohexane
***means based on solvent only In Table III, Example 26 shows that well fibrillated plexifilaments can be obtained from other types of polyolefins using this invention. The apparatus and methodology used in this example were the same as the examples in Table II except polyethylene was substituted with isotactic polypropylene with a Melt Flow Rate of 0.4, available commercially under the tradename "Profax 6823" by Hercules, Inc. Wilmington, Del. In addition, higher mixing temperature was used to compensate for the higher melting point of the polymer. The conditions used and the properties of the resultant fiber are summarized in Table III. The polymer mix contained 3.6 wt % based on polymer of Irganox® 1010 (Trademark of Ciba-Geigy Corp. for a high-molecular weight hindered polyphenol) as an antioxidant.

TABLE III

| | Example No. 26 |
|---|---|
| Apparatus | II |
| Polypropylene Conc, wt % | 16 |
| Solvent: HC | 123 |
| Mixing | |
| Temp, °C. | 180 |
| Press, psi | 1800 |
| Spinning | |
| Temp, °C. | 180 |
| Press, psi | 1300 (estimated) |
| Strand Product | |
| Denier | 483 |
| Tenacity, gpd | 1.23 |
| Quality | 4 |

TABLE IV

| | Example No. | | | | | | | | | | |
|---|---|---|---|---|---|---|---|---|---|---|---|
| | 27 | 28 | 29 | 30 | 31 | 32 | 33 | 34 | 35 | 36 | 37 |
| Apparatus | II | II | II | II | II | II | II | II | II | II | II |
| Polyethylene | LLDPE | LLDPE | HDPE | HDPE | HDPE | HDPE | HDPE | HDPE | HDPE | HDPE | HDPE |
| Melt Index | 12 | 12 | 55 | 33 | 17.5 | 6 | 6 | 6 | 6 | 6 | 6 |
| Density, g/cm$^3$ | 0.933 | 0.933 | 0.955 | 0.955 | 0.948 | 0.96 | 0.96 | 0.96 | 0.96 | 0.96 | 0.96 |
| Conc, wt % | 15.4 | 15 | 15 | 15 | 15 | 15 | 16 | 12 | 16 | 16 | 16 |
| Solvent: HC | 123 | 123 | 123 | 123 | 123 | 123 | 123 | 123 | 123 | 123 | 123 |
| Mixing | | | | | | | | | | | |
| Temp, °C. | 140 | 180 | 180 | 180 | 180 | 180 | 160 | 180 | 140 | 180 | 140 |
| Press, psig | 2400–2550 | 3500 | 3500 | 3500 | 3500 | 3500 | 3000 | 3500 | 3500 | 3500 | 2500 |
| Spinning | | | | | | | | | | | |
| Temp, °C. | 160 | 180 | 180 | 180 | 180 | 180 | 160 | 180 | 140 | 180 | 140 |
| Press, psig | ~1950 | 3500 | 3500 | 3500 | 3500 | 3500 | 3000 | 3500 | 3500 | 3500 | 2500 |
| Strand | | | | | | | | | | | |
| Product | | | | | | | | | | | |
| Denier | 554 | 570 | 457 | 525 | 561 | 624 | 853 | 686 | 852 | 607 | 968 |
| Tenacity, gpd | 1.15 | 1.3 | 1.05 | 1.6 | 1.8 | 2.5 | 2.3 | 2.3 | 2.1 | 2.5 | 2.2 |
| Quality | 4 | 4 | 4 | 4 | 4 | 4 | 4 | 4 | 4 | 4 | 4 |

I claim:

1. A solution consisting essentially of 8 to 20 weight percent of a fiber forming polyolefin and 92 to 80 weight percent of a liquid containing a halocarbon selected from the group consisting of 1,1-dichloro-2,2,2-trifluoroethane,
1,2-dichloro-1,2,2-trifluoroethane,
1,1-dichloro-1,2,2-trifluoroethane,
1,1-dichloro-2,2-difluoroethane,
1,2-dichloro-1,1-difluoroethane,
1,1-dichloro-1,2-difluoroethane,
1,2-dichloro-1,2-difluoroethane,
1,1-dichloro-1-fluoroethane,
1,2-dichloro-2-fluoroethane and
1,1-dichloro-2-fluoroethane.

2. A solution consisting essentially of 8 to 20 weight percent of a fiber-forming polyolefin and 92 to 80 weight percent of a halocarbon liquid selected from the group consisting of 1,1-dichloro-2,2,2-trifluoroethane,
1,2-dichloro-1,2,2-trifluoroethane,
1,1-dichloro-1,2,2-trifluoroethane,
1,1-dichloro-2,2-difluoroethane,
1,2-dichloro-1,1-difluoroethane,
1,1-dichloro-1,2-difluoroethane,
1,2-dichloro-1,2-difluoroethane,
1,1-dichloro-1-fluoroethane,
1,2-dichloro-2-fluoroethane and
1,1-dichloro-2-fluoroethane.

3. A solution in accordance with claim 1 wherein the liquid contains a hydrocarbon co-solvent amounting to 2 to 25 percent of the total weight of the halocarbon and co-solvent.

4. A solution in accordance with claim 1 wherein the solution also contains methylene chloride co-solvent amounting to 5 to 50 percent of the weight of the halocarbon and methylene chloride.

5. A solution in accordance with claim 1, 13, 14 or 15 wherein the halocarbon is 1,1-dichloro-2,2,2-trifluoroethane.

6. A solution in accordance with claim 1, 13, 14, 15 or 16 wherein the fiber-forming polyolefin is polyethylene.

7. A solution in accordance with claim 1, 13, or 16 wherein the fiber-forming polyolefin is polypropylene.

8. A solution consisting essentially of 10 to 20 weight percent of polyethylene having a melt index of at least 4 and a density of about 0.92–0.98 in at least one isomer of dichlorotrifluoroethane.

9. A solution according to claim 8 wherein the isomer is 1,1-dichloro-2,2,2-trifluoroethane.

* * * * *